US011601755B2

(12) United States Patent
Vargas

(10) Patent No.: US 11,601,755 B2
(45) Date of Patent: Mar. 7, 2023

(54) HEADPHONES

(71) Applicant: Jhon Vargas, Renton, WA (US)

(72) Inventor: Jhon Vargas, Renton, WA (US)

( * ) Notice: Subject to any disclaimer, the term of this patent is extended or adjusted under 35 U.S.C. 154(b) by 0 days.

(21) Appl. No.: 17/346,552

(22) Filed: Jun. 14, 2021

(65) Prior Publication Data

US 2021/0306748 A1 Sep. 30, 2021

Related U.S. Application Data

(60) Provisional application No. 63/141,932, filed on Jan. 26, 2021.

(51) Int. Cl.
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1058* (2013.01)

(58) Field of Classification Search
CPC .. H04R 5/0335; H04R 1/1008; H04R 1/1058; H04R 1/105; H04R 1/1066
See application file for complete search history.

(56) References Cited

U.S. PATENT DOCUMENTS

| | | | | |
|---|---|---|---|---|
| 7,940,924 | B2 * | 5/2011 | Amae | H04M 1/05 381/381 |
| 9,301,039 | B2 * | 3/2016 | Brunner | H04R 1/1066 |
| 10,455,314 | B1 * | 10/2019 | Yang | H04R 1/1008 |
| 2011/0206216 | A1 * | 8/2011 | Brunner | H04R 1/1066 381/74 |
| 2016/0323663 | A1 * | 11/2016 | Nisse | H04R 5/0335 |

FOREIGN PATENT DOCUMENTS

JP 2015192288 A * 11/2015

* cited by examiner

*Primary Examiner* — Angelica M McKinney
(74) *Attorney, Agent, or Firm* — Barry Choobin; Patent 360

(57) ABSTRACT

A headphone assembly that includes a support member for mounting the earphone, wherein the support member can be a headband or an ear loop. The earphones can be connected to the support member through a fixed member that can be supported on the head adjacent to the ear. The earphones are rotatably coupled to the fixed member, such as the earphones can be rotated between an on-ear position and a stowed position. In the on-ear position, the earphone is in contact with the ears of the wearer, and in the stowed position, the earphones can be rotated away from the ears.

16 Claims, 11 Drawing Sheets

HEADPHONES

CROSS-REFERENCE TO RELATED APPLICATIONS

This application claims priority to the U.S. provisional patent application Ser. No. 63/141,932, filed on Jan. 26, 2021, which is incorporated herein by reference in its entirety.

FIELD OF INVENTION

The present invention relates to headphones, and more particularly the present invention relates to headphones in which an earphone can be switched between an on-ear position and stowed position.

BACKGROUND

A range of headphone designs is known in the art. The main part of any headphone is the earphone or earpiece that includes a sound driver and mounted over an ear of a wearer of headphones. The earphones can be supported by a headband that goes over the head of the wearer. In other headphone designs, the earphones can be supported on the ear itself. The headphones can wire or wirelessly connect to a source of audio (playback), such as smartphones.

When not in use, a person may take down the headphone and store. Alternatively, a person can keep wearing the headphone but switch off the audio. For example, while talking, a person may have to temporarily remove the headphones. Moreover, using the headphone over a long duration can create ear fatigue and the user may wish to remove the headphone for some time to give rest to the ears and resume again after some time. Storing the headphone temporary and wearing again can be tedious. Moreover, safely storing the headphones can also be a problem.

Thus, a desire is there for a headphone that can be easily switched between an on-ear position when the earphone is on the ears and a stowed position when the earphone is not on the ears and without removing the headphones.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a headphone assembly that can be switched between an on-ear position and a stowed position without actually removing the headphones.

It is another object of the present invention that the headphone assembly allows a person to talk without removing the headphone.

It is still another object of the present invention that the headphones can be quickly engaged on the ears when desired.

It is yet another object of the present invention that the headphones are economical to manufacture.

In one aspect, disclosed is a headphone assembly including one or two earphones that may include sound drivers. The earphones may also include cushioning for providing comfort to the ear. The headphone assembly may also include a support member for mounting the earphone, wherein the support member can be a headband, neckband, or an ear loop. The earphones can be connected to the support member through a fixed member that can be supported on the head adjacent to the ear. The earphones are rotatably coupled to the fixed member, such as the earphones can be rotated between an on-ear position and a stowed position. In the on-ear position, the earphone is in contact with the ears of the wearer, and in the stowed position, the earphones can be rotated away from the ears.

In one aspect, the earphones can be directly coupled to the support member through the disclosed rotation mechanism, wherein the support member can be dynamically adjusted to various dimensions and contours of the wearer's head and can remain mounted to the wearer head independent of the earphones.

In one aspect, the earphone can be pivotally coupled to the fixed member, such as the earphone can be turned outwards and inwards relative to the ear for switching the earphone between the on-ear position and the stowed position.

In one aspect, the fixed member can rest against a wearer's head adjacent to the ear and keep the headphone assembly mounted, while one or both of the earphones can be moved away from the ears. The fixed member provides an ergonomic, comfortable, and secure fit of the support member independent of the earphones. The fixed member minimizes the compression of the earphone on the ear and permitting the earphone to move away from the ear with a nudge of a finger without lifting the fixed member.

In one aspect, an earcup of the earphone can include a tab that extends from a periphery of the earcup. The tab can be rotatably or pivotally coupled to the fixed member.

In one aspect, the disclosed tab and the fixed member can have male and female mating members that allow the earphone to be rotatably or pivotally coupled to the fixed member. The mating mechanism can be a snap-fit mechanism in which the fixed member can have a female mating member and the tab of the earcup can have a male mating member, where the male mating member can snugly fit into the female mating member such as to prevent slipping of the earphone by providing the desired resistance. The friction between the mating members can also be increased by providing an O-ring in the interlock and suitable glidants or lubricants can be added to smoothen the rotation of the earphone. One of the mating members can be of a right cylindrical shape that has a first radius, while another mating member can be cylindrical having a slanted top, another member has a second radius, a first height, and a second height. The first height is the height at bottom of the mating member and the second height can be of the top. The second height can be significantly larger than the first height. In one case, the second height can be 2-4 times the first height. In one case, the second height can be about thrice the first height. The slanted cylindrical shape of the mating member permits the earphone to gradually move away from the head when the earphone is rotated to the stowed position and the earphone gradually moves towards the head inwards and finally over the ear when moved from the stowed to the on-ear position.

In one aspect, the mating members can have a stop to limit the movement of the earphone relative to the fixed member. Such stops can be provided at 90-degree, 180 degrees, 270 degrees, or at any angular distance based on the comfort and utility of the headphones. The earphones can be made to rotate upwards and downward either forward or rearward.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
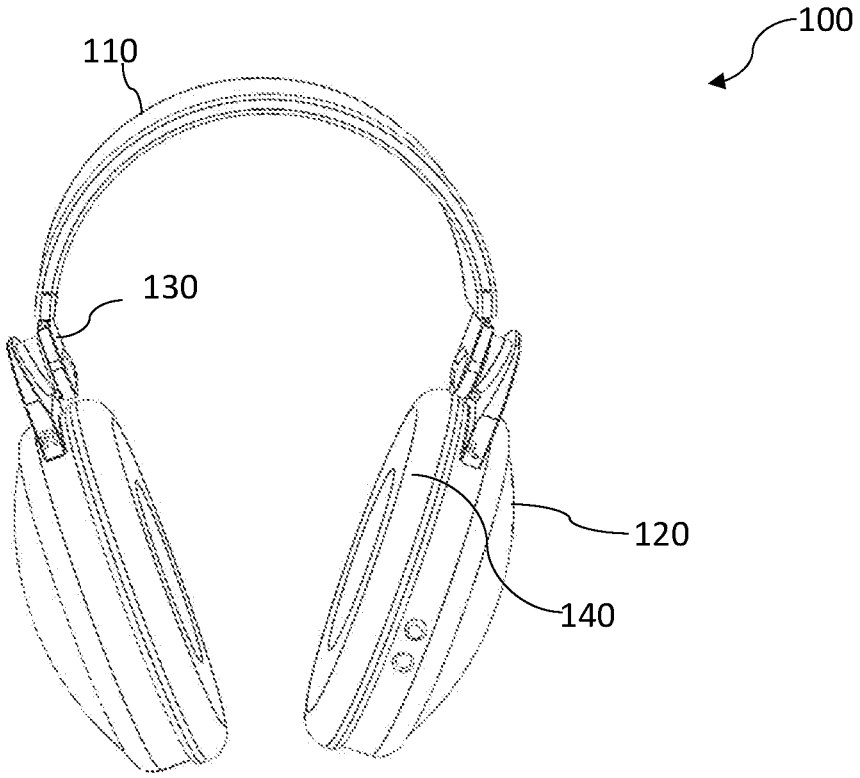
FIG. 1 is a front view of the disclosed headphone assembly, according to an exemplary embodiment of the present invention.
Figure 2:
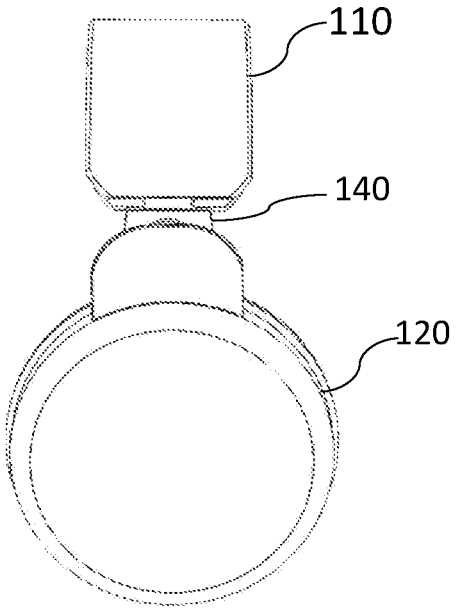
FIG. 2 is a side view of the disclosed headphone assembly shown in FIG. 1, according to an exemplary embodiment of the present invention.
Figure 3:
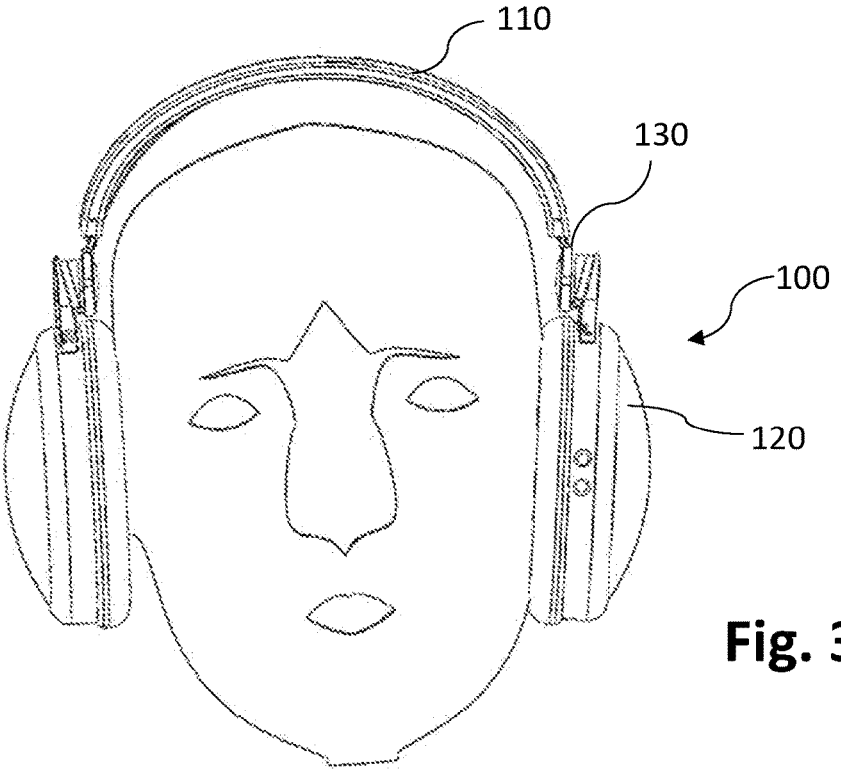
FIG. 3 shows the headphone assembly mounted to the head of a person, according to an exemplary embodiment of the present invention.

Referring to FIG. 1-3 which shows an exemplary embodiment of the disclosed headphone assembly 100 having a support member 110, a pair of earphones 120, and a fixed member 130. The headphone assembly can include a support member that allows the headphones to be mounted to the head of a person. The support member 110 can be a headband as shown in FIG. 1 that allows the headphone assembly to be mounted over the head of a wearer. The headband can be ergonomically designed to extend over the head of a person. Such headbands can be made of any lightweight material, such as plastics. The support member can also be a neckband that wraps over the neck of a wearer. Additionally, the support member can also be an ear loop that can be worn around the ear of the wearer.

The disclosed headphone assembly can also include one or two earphones. For example, the headphone can include left and right earphones for the left and right ears of a wearer.

Such stereo headphones are particularly useful for entertainment. The disclosed headphone can also include only one earphone and such headphone can be used for audio conversations. The earphones can be of a dimension to fit on the ears of a person. Moreover, suitable cushioning 140 can also be provided for comfort to the ears. The use of cushion pads in earphones is known in the art and all such cushioning pad types are within the scope of the present invention. Moreover, the headphones can include sound drivers, controls to adjust the sound, circuitry for connection to an audio source through wired or wireless connection, and any functionality known to a skilled person for use in headphones and any such functionality of earphones is within the scope of the present invention. The disclosed headphone can also include a noise cancellation mechanism and microphone, the structure and functioning of both are known to a skilled person. Also, communication headsets are known in the art that allows communicating in noisy environments. Such features of communication headsets are within the scope of the present invention.

Figure 4:
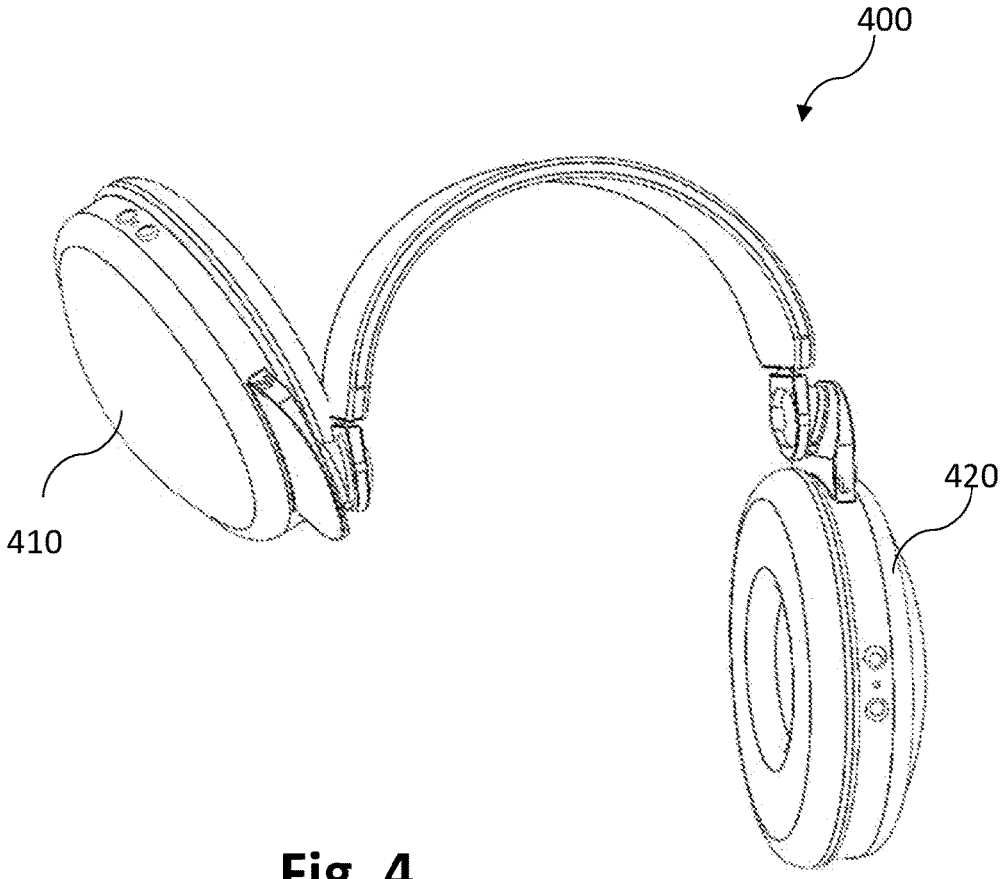
FIG. 4 shows one earphone switched to the stowed position and away from head while the other earphone is on the ear, according to an exemplary embodiment of the present invention.
Figure 5:
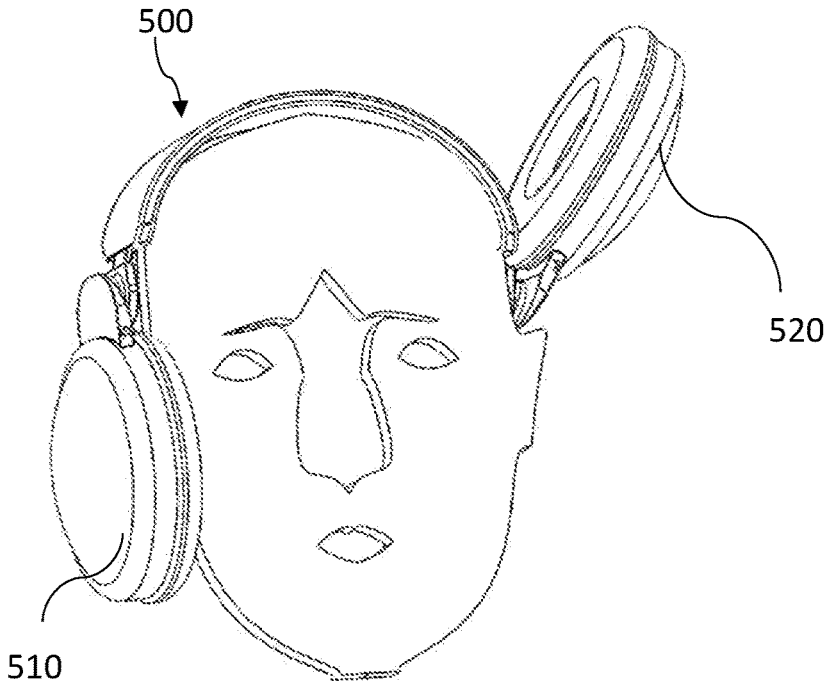
FIG. 5 shows a person wearing the headphone assembly having one earphone in the on-ear position while the other earphone in the stowed position, according to an exemplary embodiment of the present invention.
Figure 6:
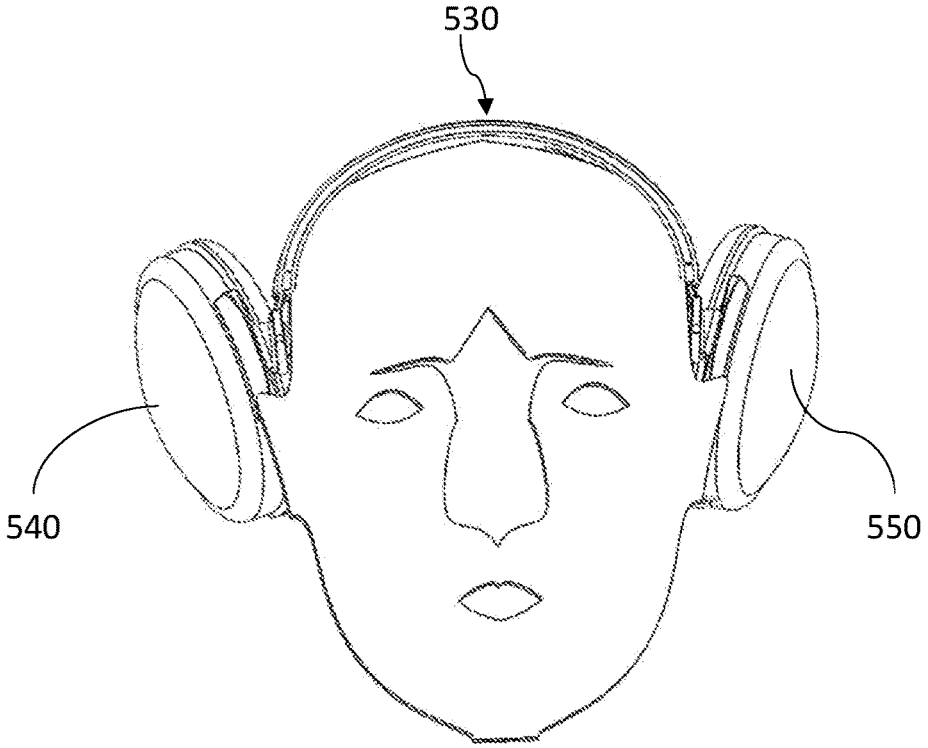
FIG. 6 shows a person wearing the headphone assembly having both earphones in the stowed position, according to an exemplary embodiment of the present invention.

The disclosed headphones permit switching one or both the earphones between an on-ear position and a stowed position. In the on-ear position, the earphones can be on the ear of the wearer and the wearer can listen to audio from the earphones. In the stowed position, the earphone can be away from the ears. FIG. 4 shows one earphone 410 of the headphone assembly 400 in the stowed position, while the second earphone 420 is in the on-ear position. The two earphones can be independently switched between the on-ear position and the stowed position. FIG. 5 further illustrates the switching mechanism of the headphone, wherein a person is wearing the headphones 500 with one earphone 510 in the on-ear position while the second headphone 520 can be seen in the stowed position. FIG. 6 shows both earphones 540 and 550 of the headphone 530 in the stowed position i.e., away from the ears, while the headphone is still over the head.

Figure 7:
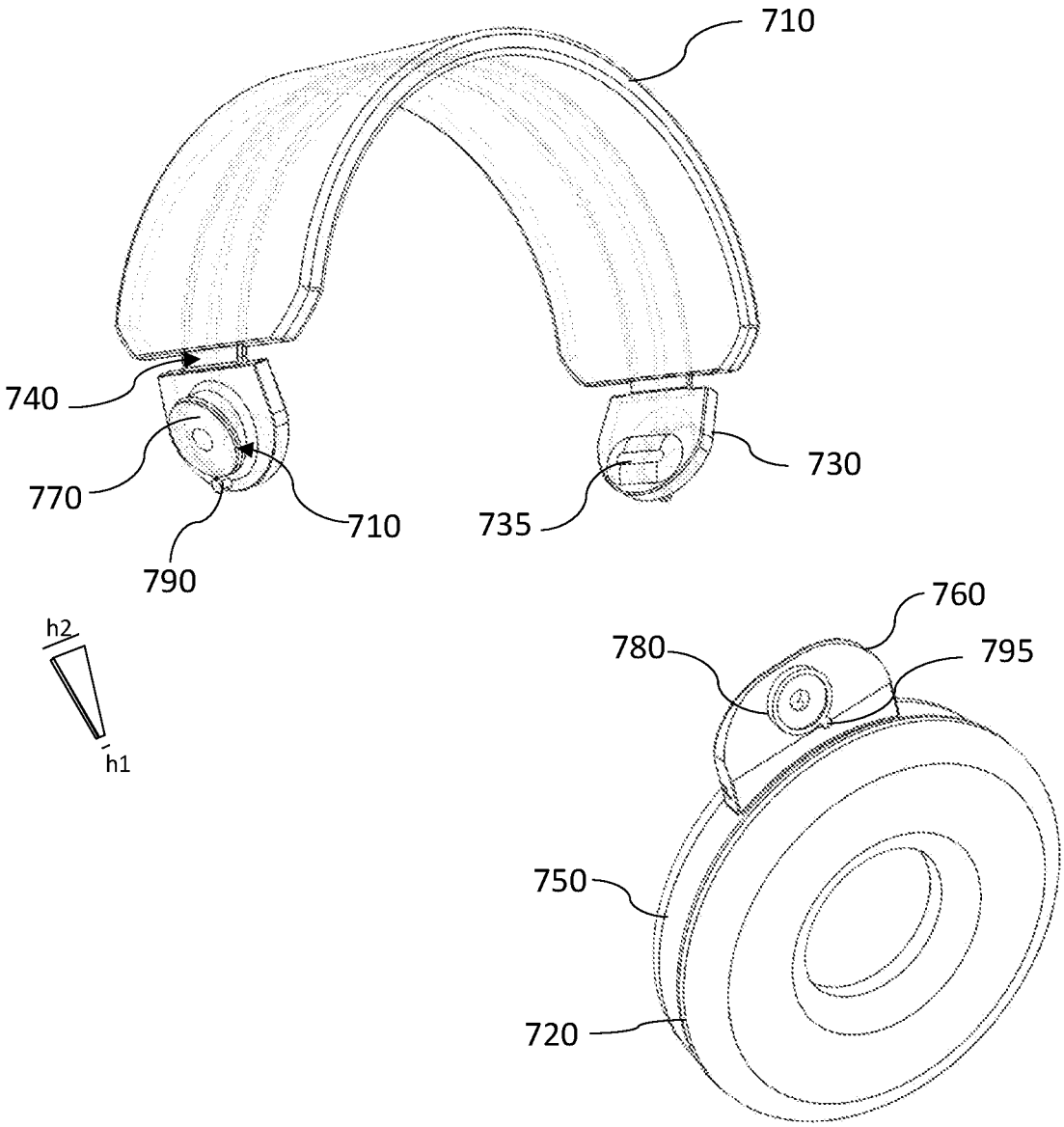
FIG. 7 is an exploded view showing the mating members of the fixed member and the earphone, and a cushion pad on an inner side of the fixed member, according to an exemplary embodiment of the present invention.

FIG. 7 is an exploded view of the disclosed headphone assembly 700 showing the support member 710 (headband) and one earphone 720 (other earphone omitted for clarity). The headband 710 can include fixed member 730 extending from opposite ends of the headband. The headband with the fixed member can mount over the head of a person and remain in a position independent of the earphones. The fixed member can be pushed against the head adjacent to the ears for stabilizing the headphone assembly. The inner side of the fixed member 730 can be provided with cushioning pads 735 that may prevent any discomfort to the wearer. The fixed member 730 can be coupled to the headband through slide extension 740 that may allow adjusting the distance between the ends of the headband and the fixed member 730. The use of sections and slide extensions for increasing or decreasing the length of the headband is known to a skilled person and all such mechanisms are within the scope of the present invention. The earphone 720 can have an earcup 750 having a tab 760 that extends from a periphery of the earcup 750. The fixed member 730 and the tab 760 can have mating members that allow the earphone 720 to be rotatably mounted to the fixed member 730. The mating members can be based on a snap-fit mechanism, threads, and like mechanism that allows the earphone 720 to be rotated relative to the fixed member 730.

FIG. 7 shows the fixed member 730 having a male mating member 770 and the tab 760 having the female mating member 780. The male mating member can snugly fit into the female mating member, such as the earphone can be rotated with slight force, but the friction prevents slipping of the earphone. To enhance the friction between the mating members, an O-ring can be provided in the interlock of the mating members. The O-rings can have a coating of glidant or lubricant for smooth movement of the mating members relative to each other. Alternatively, the surface of mating members can be provided with a layer of soft material to enhance the grip and retaining the earphone in the desired position. It is to be understood that the snap-fit mechanism can be replaced by any other mechanism such as threads for limited movement of the earphone over the fixed member. The earphone can move upward and downward. Also, the amount of rotation can be limited by providing a stop 790 in a fixed member 730 and another part of the stop 795 in the tab 760 at suitable positions. For example, the stop can be provided at 90, 180, or 270 degrees. The rotary mechanism can also be adapted to turn the mute on and off. When the earphones are switched to the stowed position, the audio can be automatically muted. Similarly, when the earphones are switched to the on-ear portion, the audio can automatically unmute. The rotary mechanism can include sensors, such as an accelerometer for detecting the position of the earphones. Such a mechanism of turning the mute on by the rotation of the earphones to the stowed position can be turned off by the user as and when desired. In case, only one earphone is switched to the stowed position, the other earphone can still be working and the audio channel of the stowed earphone can be mixed with the audio channel of the on-ear headphone.

FIG. 7 shows the female mating member 780 of a regular cylindrical shape of a first radius and the male mating member 770 cylindrical with a slanted top. The male mating member 770 can be of a second radius and first height h1 and a second height h2. The first height h1 can be a height of a bottom of the male mating member 770 while the second height h2 can be a height of a top of the male mating member 770. As can be seen in FIG. 7 and FIG. 1, the second height h2 can be significantly larger than the first height h1. The slanted male mating member 770 permits the earphone 720 to move away from the head when rotated upwards in either forward direction or rearwards. As more clearly, shown in FIG. 6, when the earphones are rotated upwards i.e., in the stowed position, the earphone move away from the head at an angle proportional to the slope of the male mating member. This earphone in the stowed position does not rest against the head but moves away from the head. While rotating the earphone from the stowed position to the on-ear position, the earphone gradually moves inwards towards the head and finally rests on the ear. Such a configuration of the coupling member permits the earphone to be switched between the on-ear position and the stowed position with a nudge of a finger, without disturbing the full headphone. Moreover, earphone does not contact the head in the stowed position which may be uncomfortable. In one case, the second height h2 can be 2-4 times the first height h1. Preferably, the second height h2 can be 2-3 times the first height h1. More, preferably, the second height h2 can be about 2.5 times the first height h1. In one case, the male mating member can be a protrusion and the female mating member can be a groove.

Figure 8:
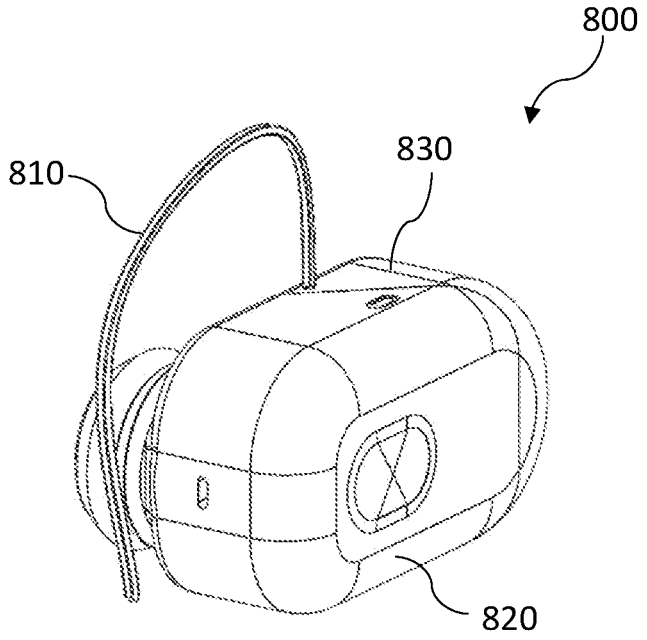
FIG. 8 shows another exemplary embodiment of the headphone assembly, according to the present invention.
Figure 9:
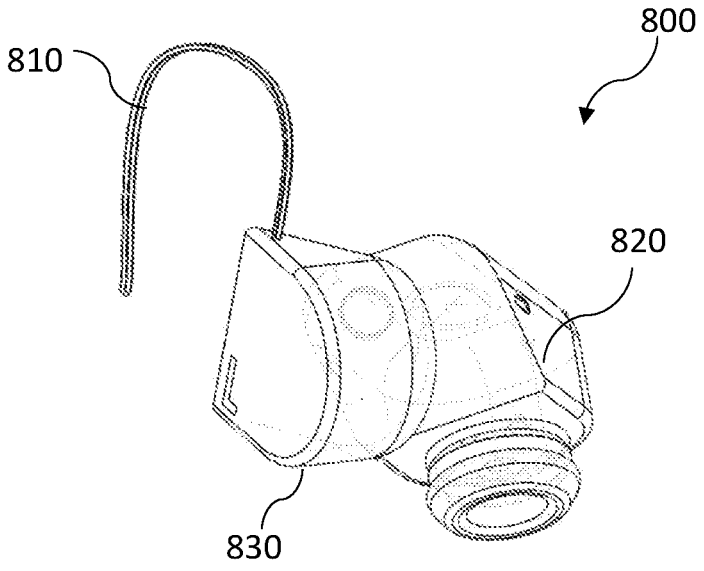
FIG. 9 shows the headphone assembly of FIG. 8 having the earphone rotated to the stowed position, according to an exemplary embodiment of the present invention.
Figure 10:
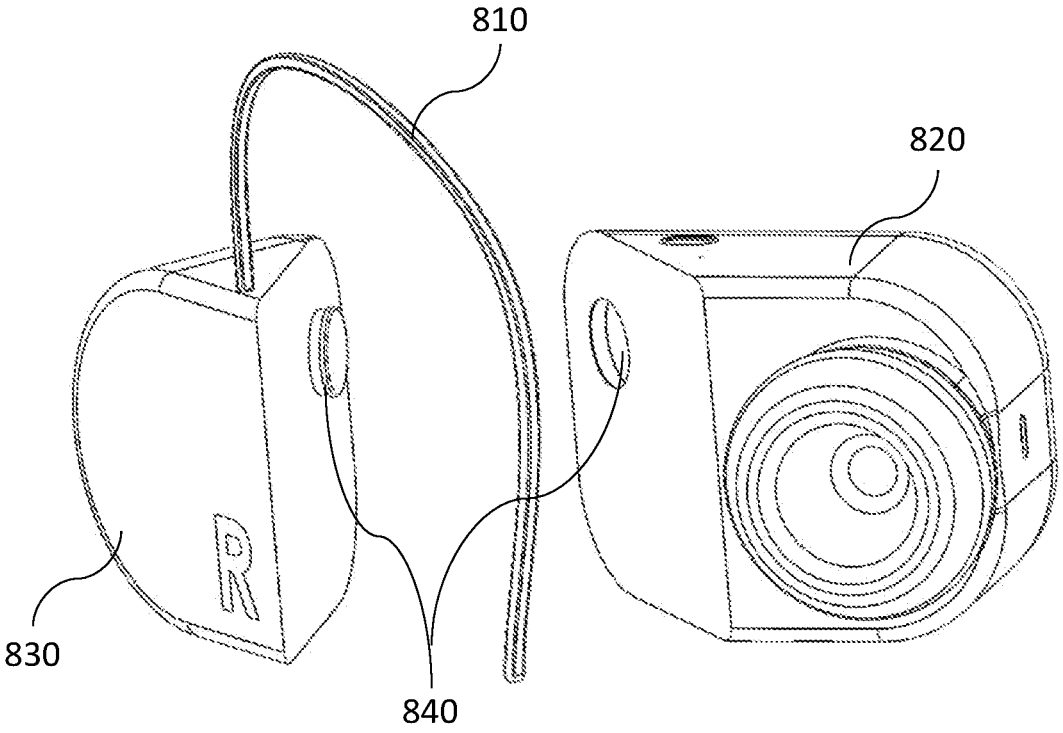
FIG. 10 is an exploded view of the headphone assembly shown in FIG. 8, according to an exemplary embodiment of the present invention.

FIG. 8 shows another exemplary embodiment of the headphone assembly 800 having an ear loop 810 as a support member. The headphone assembly 800 also includes a fixed member 830 coupled to the ear loop 810. The single earphone 820 can be rotatably coupled to the fixed member 830. FIG. 9 shows the headphone assembly 800 having the earphone 820 switched to a stowed position. Referring to FIG. 10 which shows an exploded view of the headphone assembly 800 showing the mating member 840 for coupling the earphone to the fixed member. The oblique/sloped faces of the fixed member and the earphone, shown in FIG. 8, in contact with each other permits the earphone to move outwards when rotated from the on-ear position to the stowed position and move inwards when rotated from the stowed position to the on-ear position.

Figure 11A:
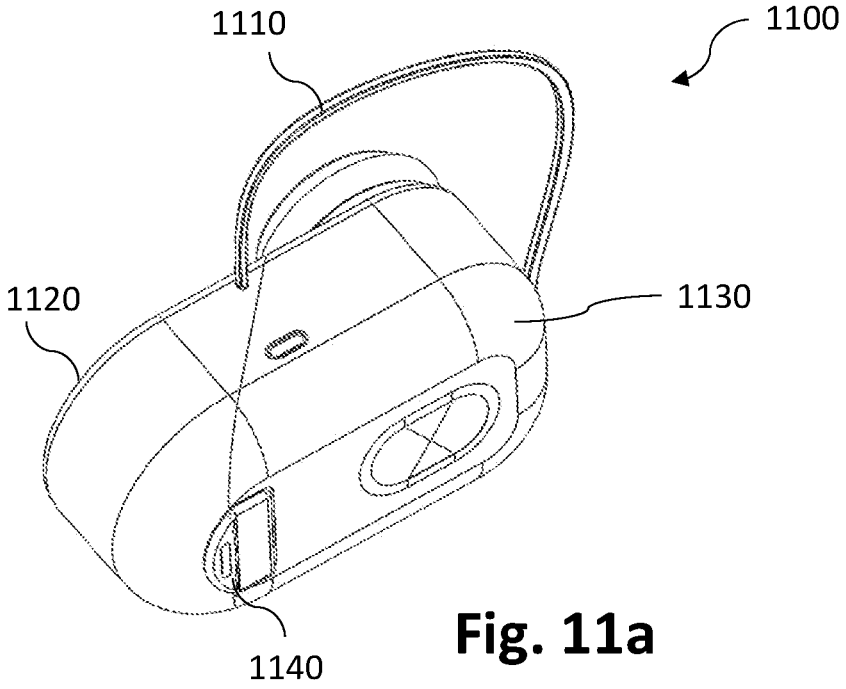
FIG. 11*a* shows another exemplary embodiment of the headphone assembly, according to the present invention.
Figure 11B:
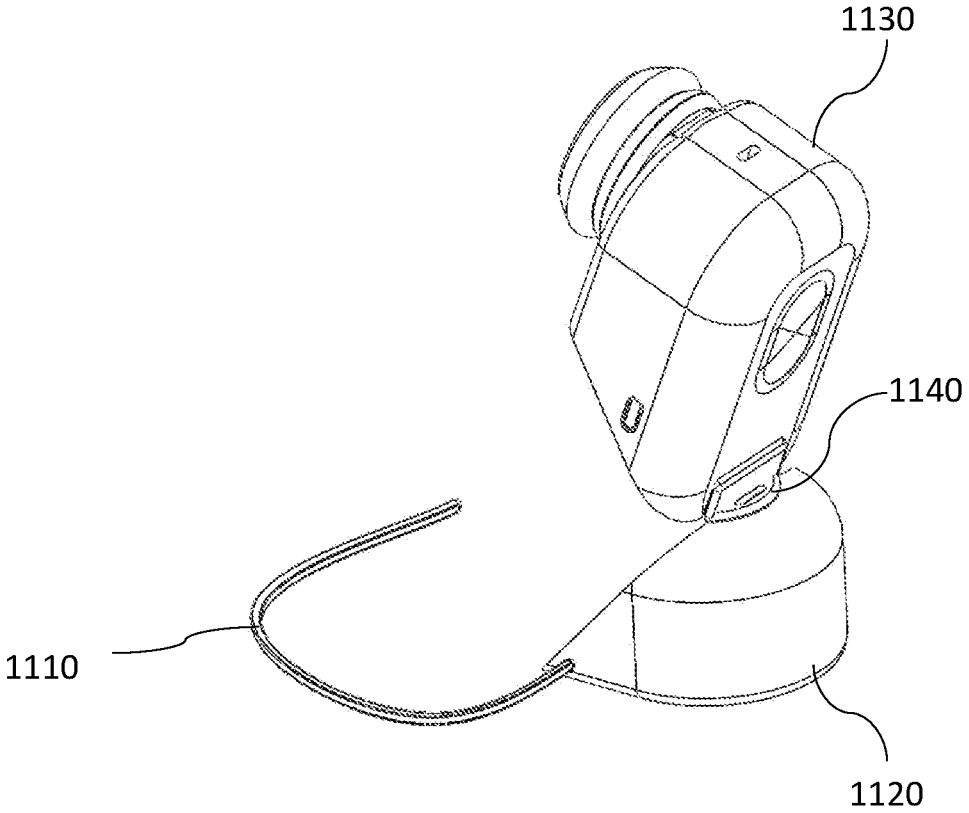
FIG. 11*b* shows the headphone assembly of FIG. 11*a* having the earphone pivoted outwards in the stowed position, according to an exemplary embodiment of the present invention.

Referring to FIG. 11*a* which shows another exemplary embodiment of the headphone assembly 1100 having the support member 1110 coupled to the fixed member 1120 and the earphone 1130 is pivotally coupled to the fixed member 1120 through a hinge joint 1140. FIG. 11*a* shows the headphone assembly having the earphone in an on-ear position. FIG. 11*b* shows the earphone turned outwards in the stowed position.

Figure 12A:
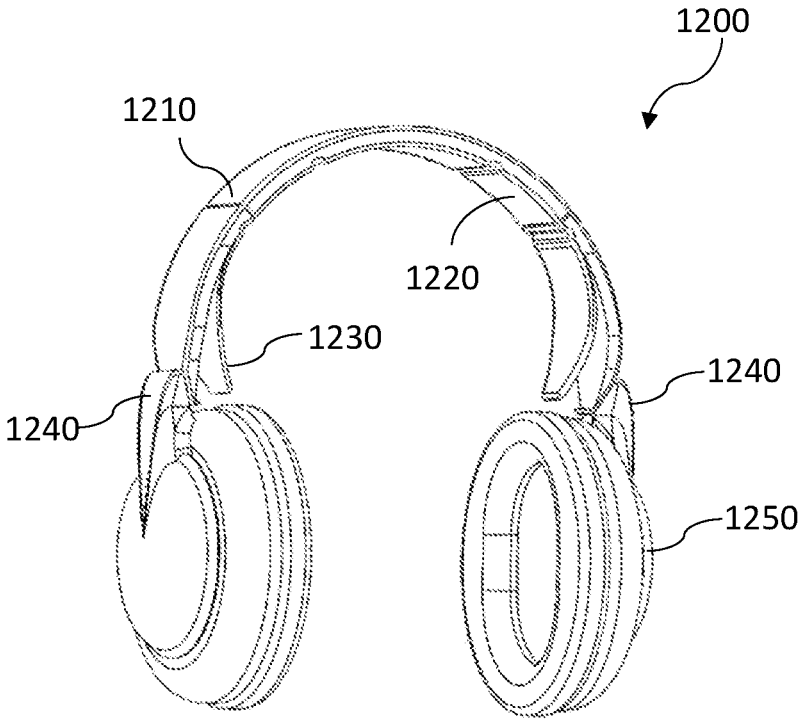
FIG. 12*a* shows another exemplary embodiment of the headphone assembly having the earphone directly coupled to the headband, according to the present invention.
Figure 12B:
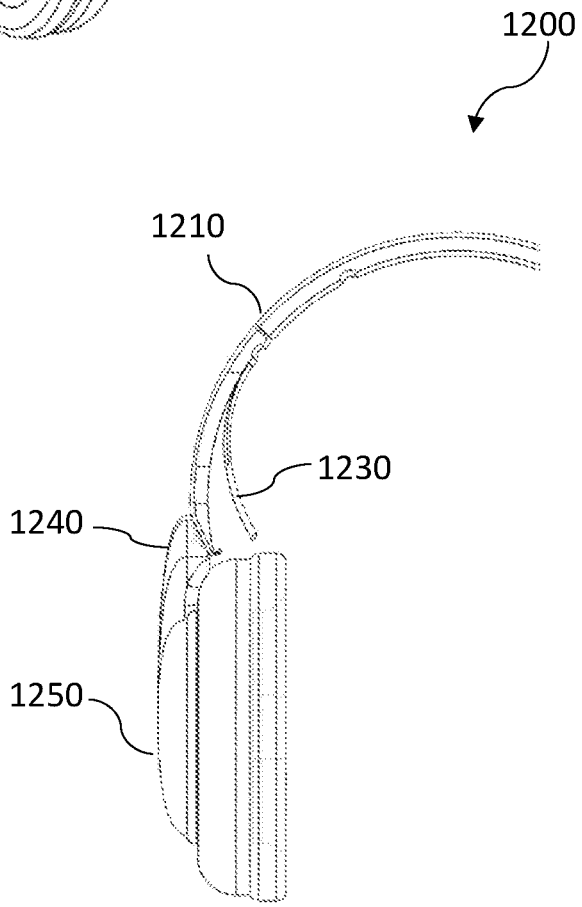
FIG. 12*b* shows a side view of the headphone assembly shown in FIG. 12*a* having the earphone coupled directly to the headband, according to the present invention.
Figure 12C:
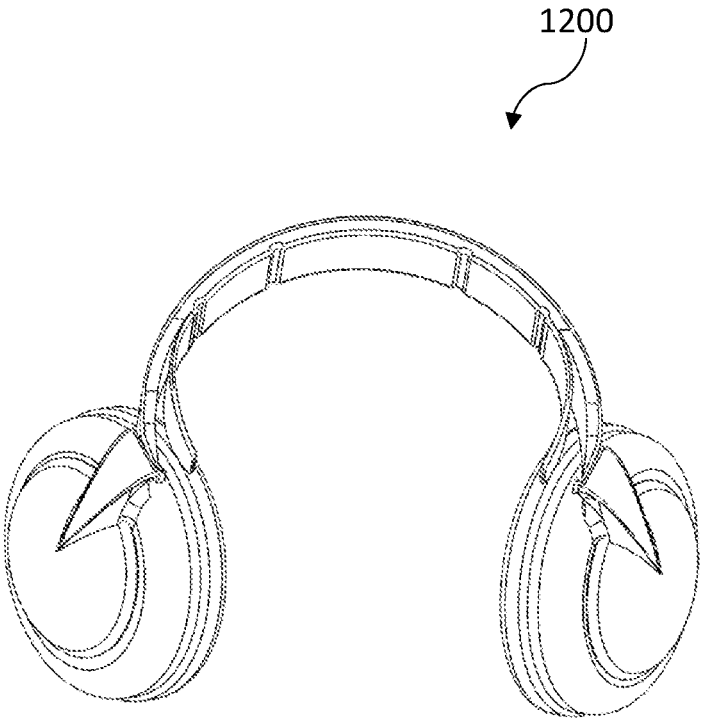
FIG. 12*c* shows the headphone assembly of FIG. 12*a* having one earphone switched to a stowed position, according to an exemplary embodiment of the present invention.

Referring to FIG. 12*a* which shows another exemplary embodiment of the disclosed headphone assembly 1200. The headphone assembly 1200 can include a head support member 1210 such as a headband that can mount the headphone assembly 1200 over the head of the wearer independent of the earphones. The head support member 1210 can optionally include a padding 1220 of cushioning material on its inner side. The head support member 1210 can firmly hold the headphone assembly 1200 in place independent of the earphones. Suitable support extensions 1230 can also be provided in the support member for holding the headphone assembly 1200 against the head. However, the support member can alone support the headphone assembly 1200 over the head and such support extensions can be optional. In one case, the head support member 1210 can include multiple sections that allow the support member to be folded for storage. As well as the sections can be coupled through slidable arms that allow adjusting the distance between the adjacent sections. This may allow fitting the headphone assembly 1200 over the heads of different sizes. The earphone 1250 can be coupled directly to the head support member 1210. The earphone 1250 can include tab 1240 that extends from a periphery of an earcup of the earphone 1250. The tab 1240 can be rotatably coupled at an end of the head support member 1210. The headband or support member can keep mounted to the head while the earphones can be rotated between an on-ear position and the stowed position. FIG. 12*c* shows the earphones switched to the stowed position.

Figure 13A:
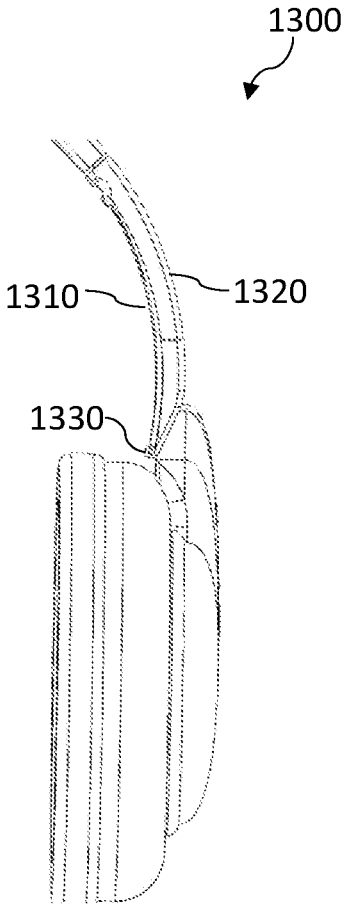
FIG. 13*a* shows the headphone assembly having a support extension, according to an exemplary embodiment of the present invention.
Figure 13B:
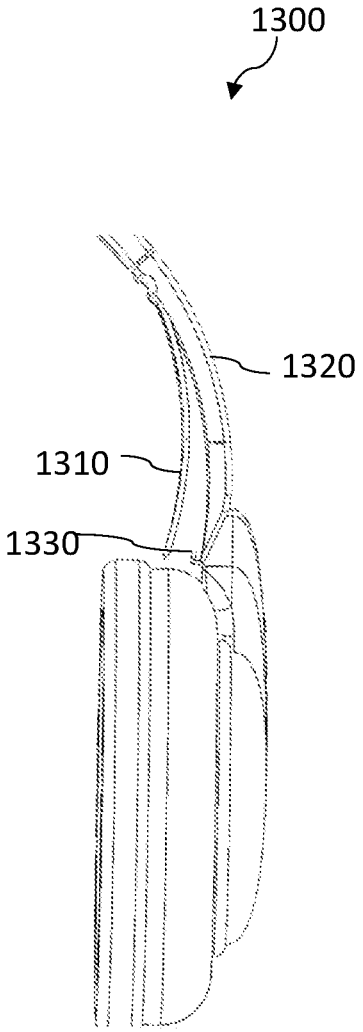
FIG. 13*b* shows the support extension of FIG. 13*a* in an open/unlatched position, according to an exemplary embodiment of the present invention.
Figure 13C:
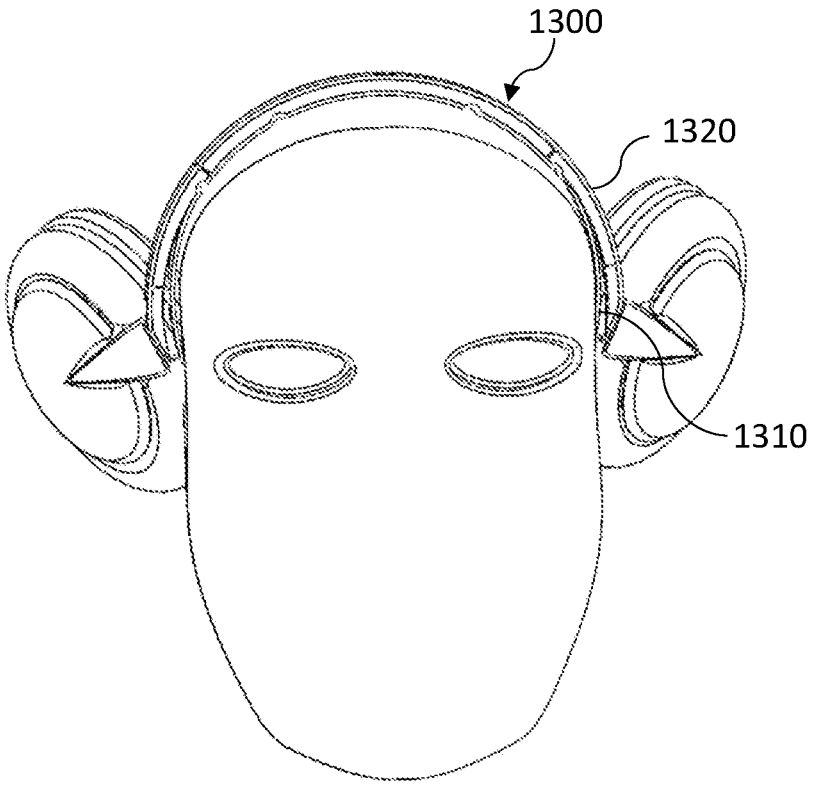
FIG. 13*c* shows the support extension of FIG. 13*b* pressed against the head of a wearer, according to an exemplary embodiment of the present invention.

Referring to FIGS. 13*a*-13*c* which shows an exemplary embodiment of the support extension that can be used to support the headband to the head of the wearer independent of the earphones. FIG. 13*a* shows the headphone assembly 1300 having a section 1320 of the support member. The support extension 1310 extends from an end of the section 1320. FIG. 13*a* shown the support extension 1310 in the latched position, FIG. 13*b* shows the support extension 1310 in the unlatched position, and FIG. 13*c* shows the support extension 1310 pressed against the head for supporting the headphone assembly 1300 over the head of the wearer while the earphone can be switched to the stowed position. The support extension 1310 can be spring-loaded and mounted on the lower face of the headband. The support extension 1310 can be calibrated to pivot up to around the earcup line (when in natural position). Support extension 1310 can be pivotally secured to the headband on one end (generally the top section) and on the opposite end is secured by a latch 1330, which can be manually pressed down to easily release the support extension 1310 allowing the head support member to extend and adjust to about the temporal or parietal regions of the head of the user when the earphone unit is rotated away from the ear. Head support member may be manufactured with plastic or alternative materials and is covered by a cushion or soft material consistent with ergonomic head supports. The support extension 1310 can be placed back into a secured position by being pressed against the latch which has a chamfered latch for allowing the lower section of the head support to glide into the latch/dock section of the section 1320. FIG. 13*a* shows the support extension 1310 in retracted position engaged to the latch 1330 and FIG. 13*b* shows the support extension 1310 released from the latch so that it can push against the head in the extended position.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A headphone assembly comprising:

a headband for mounting the headphone assembly over a head, the headband has a proximal end and a distal end, the headband has a proximal section, a mid section, and a distal section, the proximal section has the proximal end, the distal section has the distal end; and two earphones each rotatably coupled to the proximal section and the distal section of the headband such as each of the two earphones can be switched between an on-ear position and a stowed position, each earphone of the two earphones has an earcup, a tab extends from a periphery of the earcup, wherein in the on-ear position, an earphone of the two earphones is on an ear and in the stowed position the earphone is away from the ear, wherein each the proximal section and the distal section has a male mating member, and each tab of the two earphones has a female mating member, wherein the male mating member and the female mating member are configured for rotatably couple each of the two earphones to the proximal section and the distal section, wherein the female mating member is cylindrical, the male mating member is cylindrical with a slanted top, the male mating member has a second radius, a first height, and a second height, the second height is about 2-3 times the first height, wherein the first height and the second height of the male mating member are configured to permit the earphone to gradually move outwards away from the head when rotated from the on-ear position and gradually moves inwards towards the head when rotated from the stowed position to the on-ear position.

2. The headphone assembly according to claim 1, wherein the headband is having an inner cushion layer, the headband configured to keep the headphone assembly mounted to the head independent of the two earphones.

3. The headphone assembly according to claim 1, wherein the headphone assembly further comprises a sensor configured to detect switching of the earphone between the on-ear position and the stowed position.

4. The headphone assembly according to claim 3, wherein the headphone assembly is configured to mute a playback upon switching the two earphones from the on-ear position to the stowed position.

5. The headphone assembly according to claim 4, wherein the headphone assembly is configured to unmute the muted playback upon switching the two earphones from the stowed position to the on-ear position.

6. The headphone assembly according to claim 1, wherein the headphone assembly is configured such as upon switching the one of the two earphones from the on-ear position to the stowed position, mix an audio channel of the stowed earphone to an audio channel of the second on-ear earphone.

7. A headphone assembly comprising:

a support member for mounting the headphone assembly over a head, neck, or ear;

at least one fixed member coupled to an end of the support member; and at least one earphone coupled to the at least one fixed member such that the at least one earphone is capable of switching between an on-ear position and a stowed position, the at least one earphone is on the ear in the on-ear position, and the at least one earphone is away from the ear in the stowed position, wherein the headphone assembly further comprises a sensor configured to detect switching of the at least one earphone between the on-ear position and the stowed position, wherein the headphone assembly is configured to mute a playback upon switching the at least one earphone from the on-ear position to the stowed position.

8. The headphone assembly according to claim 7, wherein the at least one fixed member further comprises a cushion pad on an inner side.

9. The headphone assembly according to claim 7, wherein the support member is a headband, the at least one fixed member comprises two fixed members coupled to two ends of the headband, and the at least one earphone comprises two earphones rotatably coupled to the two fixed members, wherein the headphone assembly is configured to mute the playback upon switching the two earphones from the on-ear position to the stowed position, wherein the headphone assembly is configured, upon switching one of the two earphones from the on-ear position to the stowed position, to mix an audio channel of the stowed earphone to an audio channel of the on-ear earphone.

10. The headphone assembly according to claim 7, wherein the at least one earphone further comprises an earcup, a tab extends from a periphery of the earcup, the tab and the fixed member have mating members for rotatably coupling the tab to the fixed member.

11. The headphone assembly according to claim 10, wherein the tab has a female mating member and the fixed member has a male mating member, the male mating member snugly snap fits into the female mating member for providing resistance to rotation of the male mating member relative to the female mating member.

12. The headphone assembly according to claim 11, wherein the female mating member further comprises an O-ring configured to provide resistance to the rotation of the male mating member relative to the female mating member.

13. The headphone assembly according to claim 12, wherein the female mating member is a groove, and the male mating member is a protrusion.

14. The headphone assembly according to claim 11, wherein the mating members comprise a plurality of stops to limit the rotation of mating members to predefined intervals.

15. The headphone assembly according to claim 7, wherein the at least one earphone is pivotally coupled to the fixed member, wherein the at least one earphone pivots outwards.

16. A headphone assembly comprising:

a headband for mounting the headphone assembly over a head, the headband has a proximal end and a distal end, the headband has a proximal section, a mid section, and a distal section, the proximal section has the proximal end, the distal section has the distal end; and two earphones each rotatably coupled to the proximal section and the distal section of the headband such that each of the two earphones is capable of switching between an on-ear position and a stowed position, each earphone of the two earphones has an earcup, a tab extends from a periphery of the earcup, wherein an earphone of the two earphones is on an ear in the on-ear position and the earphone is away from the ear in the stowed position, wherein each of the proximal section and the distal section has a first mating member, and each tab of the two earphones has a second mating member, wherein the first mating member and the second mating member are configured to rotatably coupled to each other, wherein each of the first mating member and the second mating member are cylindrical, the first mating member has a slanted top with a first height and a second height, wherein the first height and the second height of the first mating member cause the respective earphone to gradually move outwards away from the head when rotated from the on-ear position to the stowed position and gradually moves inwards towards the head when rotated from the stowed position to the on-ear position.

* * * * *